United States Patent [19]

LaPointe et al.

[11] Patent Number: 4,549,269

[45] Date of Patent: Oct. 22, 1985

[54] METHODS AND APPARATUS FOR MAKING PREVAILING TORQUE NUTS

[75] Inventors: Raymond L. LaPointe, Hamilton; John D. Olmsted, Ancaster, both of Canada

[73] Assignee: Stelco, Inc., Ontario, Canada

[21] Appl. No.: 558,173

[22] Filed: Dec. 5, 1983

[30] Foreign Application Priority Data

Dec. 8, 1982 [CA] Canada ..... 417282

[51] Int. Cl.[4] ..... G06F 15/46; B21D 53/20

[52] U.S. Cl. ..... 364/472; 364/476; 364/563; 10/86 A; 29/407; 73/790; 73/805; 73/818; 81/471

[58] Field of Search ..... 364/472, 476, 513, 563; 29/240, 407; 173/12; 81/467–471; 73/790, 805, 818; 10/86 A, 86 F

[56] References Cited

U.S. PATENT DOCUMENTS

| | | | |
|---|---|---|---|
| 2,255,286 | 9/1941 | Harvey | 151/21 |
| 2,370,352 | 2/1945 | Hosking | 151/22 |
| 2,452,192 | 10/1948 | Hosking | 151/21 |
| 2,686,546 | 8/1954 | MacLean | 151/21 |
| 2,923,339 | 2/1960 | Skidmore | 151/21 |
| 3,029,856 | 4/1962 | Abbott | 151/21 |
| 3,171,459 | 3/1965 | Storch | 151/21 |
| 3,198,230 | 8/1965 | Stover, III | 151/21 |
| 3,208,494 | 9/1965 | Skidmore | 151/21 |
| 3,301,298 | 1/1967 | Stover, III | 151/21 |
| 3,311,146 | 3/1967 | Storch | 151/21 |
| 3,340,920 | 9/1967 | Johnson | 151/21 |
| 3,352,342 | 11/1967 | Jacobson | 151/21 |
| 3,356,121 | 12/1967 | Tabor | 151/21 |
| 3,412,772 | 11/1968 | Meyfarth et al. | 151/21 |
| 3,433,280 | 3/1969 | Reusser | 151/21 |
| 3,441,073 | 4/1969 | Johnson | 151/21 |
| 3,455,361 | 7/1969 | Zimmer et al. | 151/21 |
| 3,456,704 | 7/1969 | Johnson | 151/21 |
| 3,457,979 | 7/1969 | Munro | 151/21 |
| 3,459,249 | 8/1969 | Jorden et al. | 151/21 |
| 3,507,313 | 4/1970 | Stockslager | 151/21 |
| 3,543,826 | 12/1970 | Forgaard | 151/21 |
| 3,678,978 | 7/1972 | Davis et al. | 151/21 |
| 3,683,989 | 8/1972 | Follstaedt et al. | 151/21 |
| 3,969,810 | 7/1976 | Pagano | 81/470 |
| 4,115,859 | 8/1978 | Grisk et al. | 364/476 |
| 4,132,318 | 1/1979 | Wang et al. | 364/513 |
| 4,186,610 | 2/1980 | Dolezal et al. | 73/805 |
| 4,398,254 | 8/1983 | Kondo et al. | 364/472 |
| 4,422,196 | 12/1983 | Skinner | 10/86 A |

FOREIGN PATENT DOCUMENTS

| | | |
|---|---|---|
| 1039133 | 9/1978 | Canada . |
| 1149205 | 7/1983 | Canada . |

*Primary Examiner*—Jerry Smith
*Assistant Examiner*—John R. Lastova
*Attorney, Agent, or Firm*—Merchant, Gould, Smith, Edell, Welter & Schmidt

[57] ABSTRACT

To impart prevailing torque to a nut, it is squeezed between two jaws. The moment that the nut contacts both jaws is determined by monitoring the relative acceleration of the jaws. The displacement of the jaws at this time gives the dimension across the flats of the nut. From this is subtracted the desired degree of deformation giving a target displacement. When this has been reached and sensed, the jaws are stopped and then opened.

10 Claims, 4 Drawing Figures

METHODS AND APPARATUS FOR MAKING PREVAILING TORQUE NUTS

This invention relates generally to the manufacture of prevailing torque nuts, particularly of the kind used in the automotive industry, and in other areas such as appliances, agriculture and lawn mowers, where vibration and loss of fastening is a significant factor.

BACKGROUND OF THIS INVENTION

Prevailing torque nuts usually are a deformed version of a hexagonal nut for a bolt, stud or other externally threaded element, often with an integral flange washer, and the intention is for the binding and prevailing torque to take place between the threads of the nut and the bolt as the nut is threaded onto the bolt. Normally the nut is applied with a power wrench or by use of a manual torque wrench, and the person carrying out this operation will preset the wrench to a specified value in accordance with a tightening specification. If the assembly subsequently loosens, the nut will remain in place and will strongly resist being shaken loose through vibration because of the prevailing torque.

Although there are numerous methods available, many of which are patented, for applying a deformation to a hexagonal nut in order to deform it, or at least a portion of it, so that binding will take place between the nut and the bolt on which it is threaded, a satisfactory degree of consistency of deformation has been lacking with most techniques. This has meant that many of the produced nuts were rejects, as being either too greatly deformed or too little.

There has recently been developed a technique for making prevailing torque nuts which provides a substantial degree of consistency at least for a limited number of nuts. This technique is described and claimed in copending U.S. application Ser. No. 447,411 filed Dec. 6, 1982, and now U.S. Pat. No. 4,509,220, entitled Prevailing Torque Nut naming David C. Cooper and Kenneth J. Bouchard as inventors and assigned to the same assignee as this application.

The previously invented technique provides a method of making a prevailing torque nut from a regular nut, comprising the steps of placing the regular nut between two jaw members, then decreasing the gap between the jaw members so that they contact the nut, and then further decreasing the gap between the jaw members by a preset amount to permanently inwardly deform the nut.

The previously invented technique also provides an apparatus for converting regular nuts to prevailing torque nuts. The apparatus includes two jaw members and delivery means for placing the regular nuts sequentially between the jaw members. Power means are provided for controlling the spacing between the jaw members such that the jaw members first come into contact with opposite sides of the nut located between them, and then the spacing between the jaw members is decreased by a predetermined amount which is the same for all nuts.

A disadvantage of the aforementioned technique described and claimed in the aforesaid application results from the fact that the preset or predetermined amount is governed by the spacing between two movable members which move towards each other with the jaw members and then strike and abut each other to cause further closing movement of the jaws to cease.

The repeated striking together of these movable members ultimately results in changes in the preset amount taking place and, therefore, from time-to-time the movable members must be readjusted relative to each other and even replaced.

It also has been demonstrated that the process of the instant invention is faster and more accurate than the aforementioned technique and has greater flexibility and repeatability.

SUMMARY OF THE INVENTION

In view of the foregoing disadvantages of known techniques for deforming hexagonal nuts, it is an aspect of this invention to provide methods and apparatus for carrying out such deformation which are capable of rapidly, accurately and repeatedly carrying out a very uniform deformation of standard and special hexagonal or other shaped nuts, thus resulting in an output with few or no rejects over a protracted period of production.

According to one aspect of this invention there is provided a method for imparting a prevailing torque to a nut comprising the steps of:

(a) placing said nut between two relatively movable jaws,
(b) decreasing the gap between said jaws at substantially constant velocity until said jaws contact said nut,
(c) measuring the relative deceleration of said jaws to determine the point in time at which said jaws contact said nut at the onset of deceleration,
(d) determining the relative displacement of said jaws at substantially said point in time,
(e) determining a target displacement by deducting from the displacement value determined in step (d) a predetermined displacement,
(f) continuing to decrease the gap between said jaws while monitoring the spacing between said jaws,
(g) determining when said target displacement is reached, and
(h) when said target displacement referred to in step (g) is reached, signalling said jaws to stop closing movement and subsequently to open.

According to another aspect of this invention there is provided apparatus for imparting a prevailing torque to a nut comprising:

(a) two relatively movable jaws between which said nut may be placed,
(b) means for opening and closing said jaws,
(c) means connected between said jaws for producing a signal that indicates the relative displacement between said jaws and the rate of change thereof, and
(d) signal processing means for processing said signal, said signal processing means determining from said signal the point in time when said jaws have contacted said nut and the relative displacement of said jaws at substantially said point in time, determining a target displacement by deducting from the relative displacement of said jaws a predetermined displacement, monitoring said signal until said target displacement is reached and then producing an output signal for said means for opening and closing said jaws to signal said jaws to stop closing movement and then to open.

BRIEF DESCRIPTION OF THE DRAWINGS

This invention will become more apparent from the following detailed description, taken in conjunction with the appended drawings, in which.

DETAILED DESCRIPTION OF THE INVENTION INCLUDING THE PREFERRED EMBODIMENT

Figure 1:
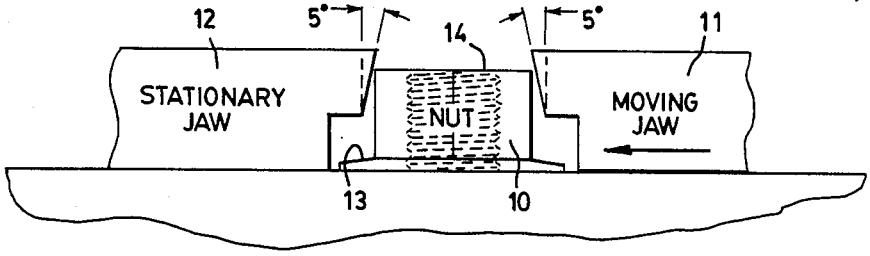
FIG. 1 is a schematic representation of movable jaws that may be employed to deform a nut in accordance with the technique of the present invention, a nut to be deformed also being shown in the Figure.

Referring to FIG. 1, a stock nut 10 to be deformed is shown in the nut track between a moving jaw 11 and a fixed jaw 12. In the embodiment shown nut 10 happens to have an integral washer 13, but this is entirely optional. The nut also happens to be hexagonal in configuration, but this also is not critical to the invention. Because of the presence of washer 13, the lower parts of jaws 11 and 12 are recessed to accommodate the washer such that there is no compression of the washer between the jaws.

The upper parts of the jaws each are inclined towards the other at 5° with respect to the vertical. This angle is not critical, nor is the depth of the upper parts of the jaws that actually contact the flats of the nut. However, the angle and depth are factors in determining the degree of prevailing torque that will be imparted to a nut and must be selected and correlated to each other with that in mind.

In the practice of the present invention a nut 10 is fed into the nut track between open jaws 11 and 12. This may be done manually, for example, but, more commonly, an automatic nut feeding device would be employed. Such devices are known in the art and need not be described herein. One form of suitable nut feeding device is shown in the aforementioned copending patent application.

Nut 10 should be fed into the nut track between jaws 11 and 12 in such an orientation that two of its flats are at least approximately parallel to imaginary, horizontal, straight lines on the inclined faces of jaws 11 and 12.

Jaw 11 then is moved toward jaw 12 and nut 10, contacts nut 10 and, ultimately, compresses the upper part of nut 10 between itself (jaw 11) and jaw 12. In the embodiment shown deformation of nut 10 takes place on the flats of nut 10 starting at the top face 14 of nut 10 and diminishing toward the bottom of the nut at an angle of 5° to the vertical. The resulting interference fit occurs only at the upper part of the nut to produce the prevailing torque feature. The bottom of the threaded opening in the nut is not deformed.

Figure 2:
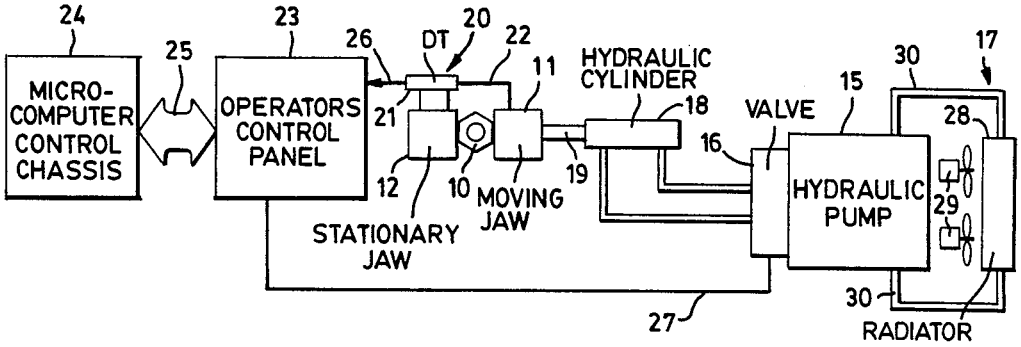
FIG. 2 is a schematic representation of one form of apparatus that may be used in the practice of the instant invention.

Referring now to FIG. 2, one embodiment of apparatus for carrying out the present invention is shown. It includes what can be an off-the-shelf hydraulic package comprising a hydraulic pump 15, a solenoid-operated valve 16, a cooling system 17 and a hydraulic cylinder 18; moving and stationary jaws 11 and 12 respectively, the former being moved by the piston (not shown) and connecting rod 19 of hydraulic cylinder 18; a displacement transducer 20 (hereinafter referred to as a DT) having its fixed part 21 secured to jaw 12 and its movable part, core 22 secured to jaw 11; an operator's control panel 23; and a microcomputer 24. The latter is electrically connected to control panel 23, as shown by arrow 25, for passage of signals back and forth between components 23 and 24. The output of DT is electrically connected to control panel 23 via a conductor 26 and ultimately provides displacement signals via panel 23 to microcomputer 24. Control panel 23 is connected via a conductor 27 to valve 16 to control the operation thereof.

Cooling system 17 is provided for cooling the oil used in the hydraulic system. In the embodiment shown it consists of a radiator 28, e.g., of the automotive type, fans 29 and hydraulic lines 30 connecting pump 15 and radiator 28.

Figure 3:
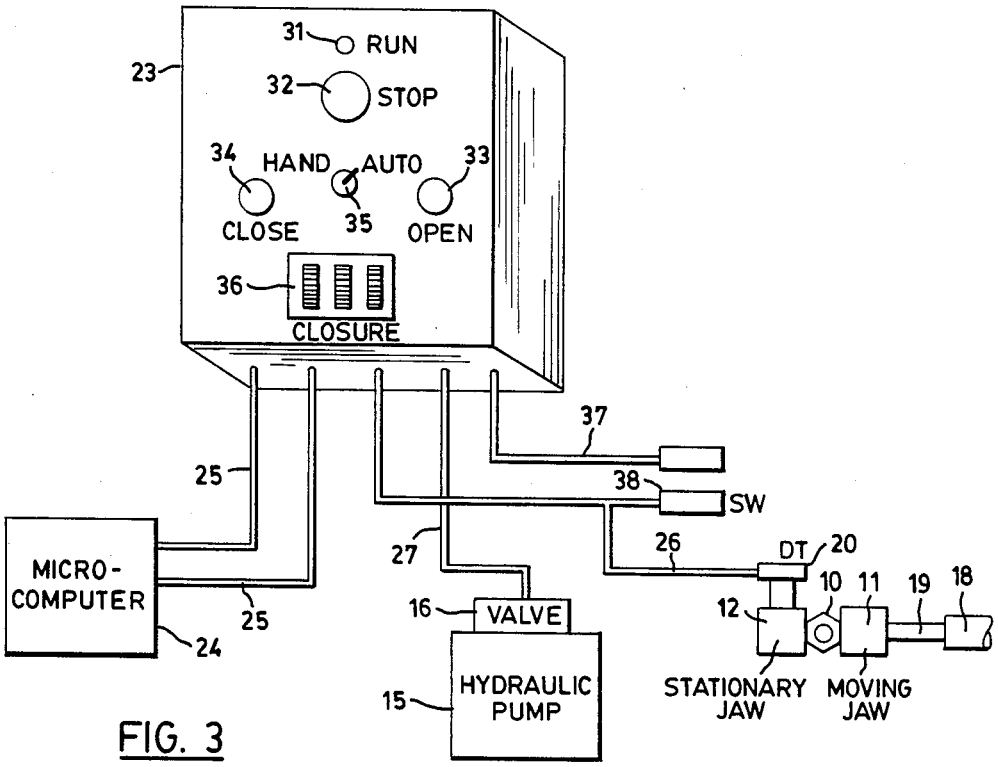
FIG. 3 shows in greater detail some of the components shown in FIG. 2.

Certain of the components of FIG. 2 are shown in greater detail in FIG. 3. In particular, operator's control panel 23 is shown in greater detail therein and will be seen to include run and stop pushbuttons 31 and 32 respectively, open and close pushbuttons 33 and 34 respectively for controlling opening and closing of the jaws, a switch 35 for selecting manual or automatic operation and graduated, rotary thumbwheel switches 36 to preset the desired degree of deformation.

In addition to the various signal lines that are also shown in FIG. 2, a conductor 37 is connected from panel 23 to the nut feeder (not shown) and provides a signal to the nut feeder to indicate that a nut should be fed. A switch 38 connected to conductor 26 provides a signal to control panel 23 to indicate when a nut has been fed.

While not to be considered as limiting, the following is a listing of various components and specifications thereof that can be used in the practice of the present invention.

Hydraulic pump 15 can be an Enerpac (trade mark) model PER 5045 AC. This unit comprises a 2.24 kW (3 HP) electric motor coupled to a radial piston pump capable of delivering 69 kPa (10,000 p.s.i.) at 2000 $cm^3$/min (120 cu.in./min.), the pressure of the system being kept below 24.8 kPa (3600 p.s.i.) by an adjustable relief bypass valve to allow safe operation. The pressure generated by this system is adequate for deforming 10 mm nuts and may be adjusted for different sizes of nuts if necessary.

Cooling system 17 may be an automotive transmission radiator 28 with two 3 $m^3$/min (105 cu. ft./min.) fans 29. In the present embodiment this cooling system kept the hydraulic oil below 40° C. during continuous operation with an ambient temperature of 22° C.

Solenoid control valve 16 may be a Sperry-Vickers (trade mark) model DG4V3-8C-W-B-10. Such a valve was used in place of the valve that came with the pump. It features direct solenoid spool valving with no pilot circuit for fast repeatable hydraulic switching, easily replaceable solenoid coils featuring circulation of hydraulic oil through the cores for cool operation, and is an inexpensive off-the-shelf unit. The control valve was fitted to the hydraulic pump package by fastening it to the bypass valve controlling delivery pressure and fitting the entire assembly to a custom-made manifold block, allowing adaptation to the delivery and return ports on the pump unit. This valve has a specification of 19 liters/min. at 34.5 kPa (5,000 p.s.i.).

Hydraulic cylinder 18 may be an Enerpac model RD93 double acting cylinder 69 kPa, 80 kN (10,000 p.s.i., 9 tons).

The DT 20 may be a Durham Instruments (division of Buchan Instruments Inc.) linear variable displacement transducer model No. 200DC-D made by Schaevitz Engineering of Camden, N.J., U.S.A.

Microcomputer 24 can be Intel (trade mark) based and can consist of the following boards and chassis all made by Intel:

SBC 80/24—4.8 MHz CPU board based on an 8085 CPU

SBX 332—high speed math module

SBC 711—A/D board (analog to digital converter)

SBC 508—digital I/O board (input/output)

ICS 80—chassis with an SBC 640 power supply.

The functions of the various controls of operator's panel 23 are as follows:

Emergency Stop 32—causes the jaws to stop movement by disconnecting the solenoid control voltage Run 31—reconnects the solenoid control voltage enabling normal operation Auto-Hand 35—enables automatic microcomputer controlled operation or manual operation of the deformation vise Open 33—opens the vise jaws when the auto-hand selector switch is in the hand position Close 34—closes the vise jaws when the auto-hand selector switch is in the hand position Closure 36—allows the operator to dial in deformation when the selector switch is in the auto position.

To understand the operating technique of the present invention it must be understood that the primary controlling factor of the prevailing torque nut is the geometry of the deformation. This has two main constituents, the angle of closure and the total deformation distance. Of these, the angle of closure is fixed when the jaws are machined, and the total deformation distance is a variable. To meet a torque specification, the deformation distance or closure is the variable which is controlled.

For consistency of torque performance from nut to nut, closure must be tightly controlled during manufacture. Since there is a variation in the dimension across the flats, and in the bore or pitch diameter dimension, the controlling device must be able to compensate for these variations to maintain consistent closure. The measured, and therefore compensated for variable, is the dimension across the flats. At this time there is no reliable noncontacting way of measuring pitch diameter, but the degree of inconsistency introduced thereby probably is not significant.

In operation, DT 20 measures the distance between jaws 11 and 12 and provides an electrical signal that indicates the displacement between the jaws. As jaw 11 closes on jaw 12, the rate of closure depends on whether or not both jaws are in contact with nut 10. To determine the dimension across the flats of nut 10, which dimension may vary from nut to nut, the first derivative of displacement, namely velocity, is determined and from that the second derivative of displacement, namely acceleration. Microcomputer 24, which receives the displacement signal from DT 20, calculates the velocity of moving jaw 11 after giving the signal for jaw 11 to close. This velocity will increase from start-up to a constant velocity up to the point where the jaws contact nut 10. Microcomputer 24 also calculates the acceleration of jaw 11. The moment when nut 10 is contacted by both jaw 11 and jaw 12 can be precisely determined by determining the point in time at which jaw 11 begins to decelerate. Thus, microcomputer 24 monitors the velocity and acceleration of jaw 11 and, when deceleration of jaw 11 takes place due to contact with nut 10, uses the position reading given by DT 20 as the dimension across the flats of the particular nut. It then is necessary to subtract from that reading the desired total deformation or closure to provide a target position that represents the required closure for the particular nut. The displacement signal from DT 20 is monitored by microcomputer 24 for a match with the aforesaid target position, and when the match is found, microcomputer 24 instructs jaw 11 to stop and then open to complete the cycle.

Accurate displacement measurement, which is a key factor in the practise of the present invention, can be assured by the use of a high quality DT and analog-to-digital converter in microcomputer 24. In the system hereinbefore described a resolution of greater than 0.00254 mm (0.0001 in.) and a conversion rate of over 1000 samples/sec. were realized. By use of an averaging algorithm in the microcomputer, electrical and vibrational noise can be minimized.

Figure 4:
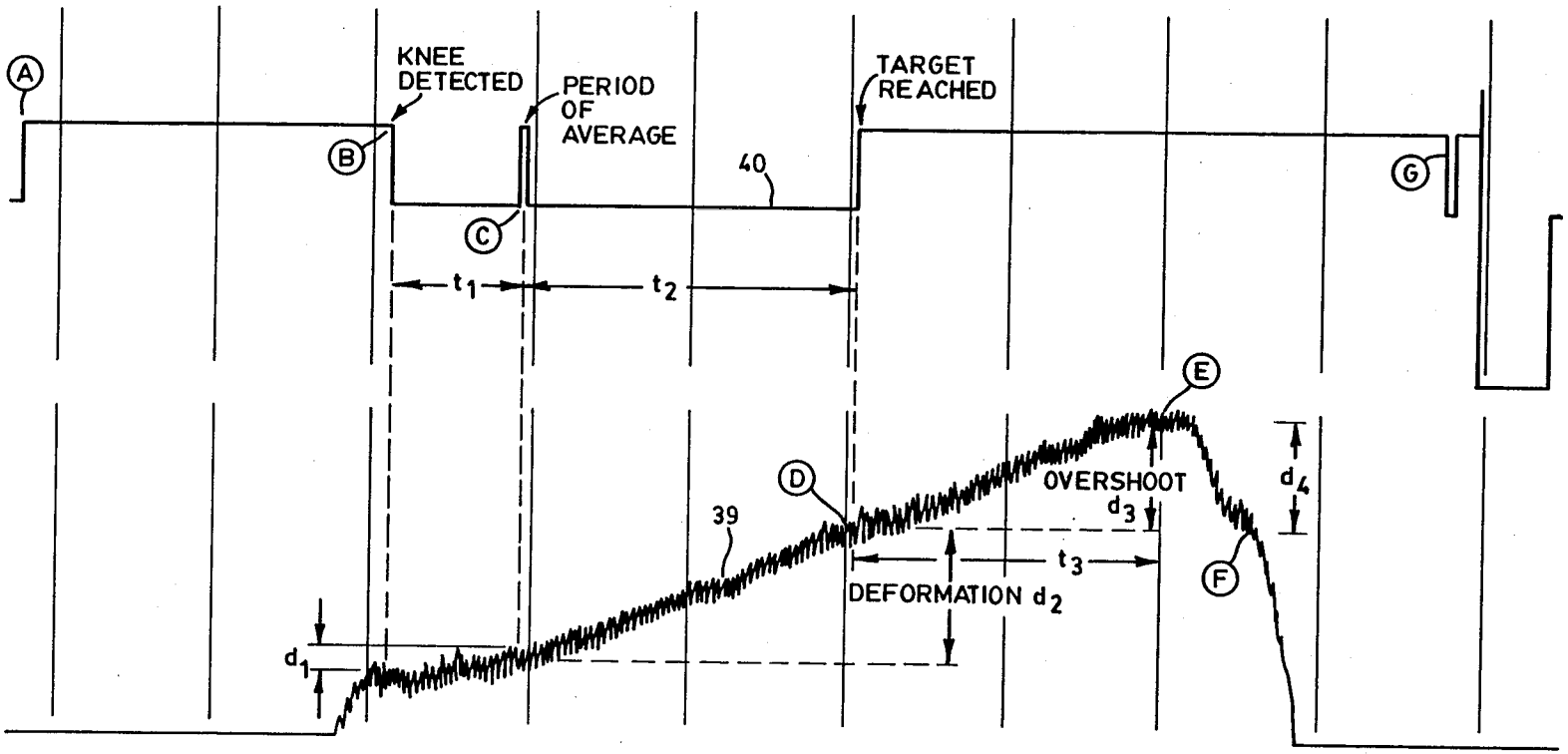
FIG. 4 is a graph which shows microcomputer status (upper trace) and jaw displacement (lower trace).

Turning now to FIG. 4, which explains the operation of the invention in greater detail, trace 39 is the dynamic displacement response of the system, while trace 40 is the microcomputer status signal for timing purposes.

At event A microcomputer 24 recognizes that a nut 10 has been fed into the nut track between jaws 11 and 12 and sends a signal to valve 16 to close jaw 11 on jaw 12 (hydraulics forward). Jaw 11 accelerates to a constant velocity with little hydraulic pressure buildup, since nothing inhibits its forward motion.

At event B jaw 11 hits nut 10, i.e., there is physical contact between nut 10 and both jaws 11 and 12. Jaw 11 decelerates at this time to a velocity of near zero, because there is little hydraulic pressure buildup behind the piston of hydraulic cylinder 18 due to delivery volume restrictions. It will be noted that at this time the microcomputer status signal 40 goes low indicating that microcomputer 24 recognizes this as the initial nut contact position. At this point the system is stabilizing.

In order to give time for the system to stabilize, the base reading of jaw position is not made until after a delay time $t_1$. During time $t_1$ elastic but not plastic deformation of nut 10 will take place. Time $t_1$ will vary primarily dependent upon the hydraulics of the system but also on the mechanics thereof.

It has been observed that after the period of elastic deformation there always appears a plateau in trace 39. When that plateau occurs after delay time $t_1$ eight sequential samples (readings of DT 20) are taken and averaged to determine the "base reading", which is a reliable reading of nut width across the flats.

It can be understood from the foregoing that time $t_1$ is required to provide time for the nut and jaw to settle into position and for hydraulic pressure to build up in hydraulic cylinder 18. Displacement $d_1$ is the apparent displacement of the jaws as the nut position settles down. This will vary from nut to nut. At event C the microcomputer status signal 40 indicates the time at which the base readings are taken. The target displacement $d_2$ is calculated. It is the difference between the base reading and the desired closure. As the jaws continue to close, the microcomputer monitors the displacement until the target, D, is reached. The time it takes to deform the nut is $t_2$.

At event D the target is reached. The microcomputer status signal 40 indicates recognition that the target displacement $d_2$ has been reached or exceeded and sends out a reverse signal to the hydraulics to reverse jaw movement. At this time the signal causes the solenoid of valve 16 to position hydraulic control valve 16 to dump forward pressure to the tank and to build up reverse pressure on hydraulic cylinder 18.

Event E is overshoot due to the mechanical response time of the system. During time interval $t_3$ closure continues, and displacement $d_3$ is the resulting overshoot. At the end of time interval $t_3$ the resistance of nut 10 to closure plus the reverse hydraulic pressure equals the forward hydraulic pressure and movement of jaw 11 stops. As reverse hydraulic pressure builds up and forward hydraulic pressure drops, nut 10 pushes the piston of hydraulic cylinder 18 back towards its open position. This is springback.

Event F is the end of springback. At this point the reverse hydraulic pressure alone moves jaw 11 open. Displacement $d_4$ is an indication of the springback of the nut.

At event G the microcomputer status signal 40 indicates recognition of the reverse stop position, and a signal is sent out to cease opening the piston of cylinder 18.

Because of overshoot and springback the target displacement $d_2$ may not be the actual final deformation imparted to nut 10. However, for any given setting of $d_2$, which is set by thumbwheel 36, and for nuts 10 that are essentially alike (except for minor variations in dimensions across the flats), the amount of overshoot and springback will be constant and measurable. Thus, if $d_2$ is set for 30 units using thumbwheel 36, the amount of deformation after springback may be 28 units. To achieve the desired 30 units, thumbwheel 36 thus will have to be set higher. Eventually by this empirical method the exact setting of thumbwheel 36 to give the desired deformation for given nuts can be determined.

Overshoot time $t_3$ is fixed and repeatable. Thus, system accuracy can be improved at the expense of repetition rate by reducing the deformation rate. This can be accomplished by adding an accumulator to the forward hydraulics. This reduces the slope during overshoot resulting in greater closure accuracy due to less variation in overshoot deformation $d_3$. Since deformation rate is proportional to hydraulic pressure and mechanical properties of the nut, and since hydraulic pressure is constant, it can be seen that deformation rate is proportional to mechanical properties of the nut. By slowing down the deformation rate, variations in the mechanical properties of the nut, and thus overshot, influence the total deformation or closure to a lesser degree resulting in greater closure accuracy.

The other way to realize greater closure accuracy is to decrease overshoot time $t_3$. This is primarily dependent on the response of valve 16 and capacity. Time $t_3$ consists of the response or spool transition time of valve 16 and of the capacity (volume) rating which determines the time to dump the forward hydraulic pressure to tank.

Appendix 1 appended hereto contains the source code listing of the control and diagnostics program. It is to be clearly understood, however, that a microcomputer is not essential to the practice of the instant invention. The detection of deceleration of jaw 11, the determination of displacement at that time, the subtraction of desired deformation therefrom to calculate target displacement and the detection of target displacement all can be carried out using equipment other than a microcomputer.

While preferred embodiments of this invention have been described herein, those skilled in the art will appreciate that changes and modifications may be made therein without departing from the spirit and scope of this invention as defined in the appended claims.

APPENDIX 1

FORTRAN COMPILER

```
ISIS-II FORTRAN-80 V2.1 COMPILATION OF PROGRAM UNIT TARLOK
OBJECT MODULE PLACED IN :F1:DOCU1.OBJ
COMPILER INVOKED BY:  FORT80 :F1:DOCU1.PAT

                PROGRAM TARLOK
                INTEGER X.X67X.GUSBOB.SPRECK.BUDDY.XZY.GSA.PSL.JOE
                INTEGER I.TNT.LIMP.X76X.XX
                REAL XXX.X1XX
                INTEGER*2 JOE1
                INTEGER*1 JOE2
                COMMON /JOE1/JOE1
                COMMON /JOE2/JOE2
                CALL OUTPUT(18.255)
                X76X=18
                CALL AD(X76X.XX)
                JOE2=1
                CALL OUTPUT(18.255)
                CALL CIT
                IF(JOE1.LT.500)GOTO 20
                CALL OUTPUT(18.253)
      10        CALL CIT
                IF(JOE1.GT.3000)GOTO 10
      20        CALL OUTPUT(18.255)
                CALL OUTPUT(16.254)
                X=0
      30        CALL INPUT(17.X67X)
```

```
23              IF(X67X.EQ.0)GOTO 34
24      32      CALL INPUT(17.X67X)
25              IF(X67X.NE.0)GOTO 32
26              X=X+1
27              IF(X.LT.100)GOTO 32
28              X=0
29              CALL OUTPUT(16.255)
30      34      CALL INPUT(17.X67X)
31              IF(X67X.NE.1)GOTO 34
32              X=X+1
33              IF(X.LT.100)GOTO 34
34              X=0
35              CALL OUTPUT(16.255)
36              CALL OUTPUT(16.253)
37              X76X=16
38              CALL AD(X76X.PSL)
39              PSL=PSL*10.24
40      100     CALL OUTPUT(18.254)
41              SPRECK=0
42              X=0
43      35      CALL CIT
44              IF(JOE1.LT.1500)GOTO 35
45              CALL CIT
46              GUSBOB=JOE1
47      40      CALL CIT
48              X=0
49              SPRECK=JOE1-GUSBOB
50              GUSBOB=JOE1
51              IF(SPRECK.GT.6)GOTO 40
```

FORTRAN COMPILER

```
52      41      X=X+1
53              CALL CIT
54              SPRECK=JOE1-GUSBOB
55              GUSBOB=JOE1
56              IF(SPRECK.LT.6.AND.X.LT.4)GOTO 41
57              IF(X.LT.4)GOTO 40
58              CALL OUTPUT(16.255)
59              IF(JOE1.GT.3900)GOTO 58
60              X=XX*10+1000
61      42      CALL YDR(X)
62      45      X=0
63              CALL OUTPUT(16.253)
64              XZY=JOE1
65              X=X+1
66      48      CALL CIT
67              XZY=XZY+JOE1
68              X=X+1
69              IF(X.LT.8)GOTO 48
70              CALL OUTPUT(16.255)
71              XZY=XZY/8
72              X=0
73              GSA=XZY+PSL
74              IF(GSA.GT.4050) GOTO 58
75      50      CALL CIT
76              IF(JOE1.LT.GSA)GOTO 50
77      55      CALL CIT
78              IF(JOE1.LT.GSA)GOTO 55
79      58      CALL OUTPUT(18.253)
80              CALL OUTPUT(16.253)
81      70      CALL CIT
82              IF(JOE1.GT.3000)GOTO 70
```

```
83                CALL OUTPUT(18.255)
84      90        CALL OUTPUT(16.255)
85                GOTO 10
86                END
```

```
MODULE INFORMATION:

     CODE AREA SIZE      = 0270H    624D
     VARIABLE AREA SIZE  = 0024H     36D
     MAXIMUM STACK SIZE  = 0004H      4D
     86 LINES READ

     0 PROGRAM ERROR(S) IN PROGRAM UNIT TARLOK

     0 TOTAL PROGRAM ERROR(S)
     END OF FORTRAN COMPILATION
```

```
FORTRAN COMPILER

ISIS-II FORTRAN-80 V2.1 COMPILATION OF PROGRAM UNIT AD
OBJECT MODULE PLACED IN :F1:DOCU2.OBJ
COMPILER INVOKED BY:  FORT80 :F1:DOCU2.PAT
```

```
 1                SUBROUTINE AD(X76X.XX)
 2                INTEGER T
 3                INTEGER XX.X76X
 4                I=0
 5                IF(X76X.EQ.18)GOTO 10
 6                CALL INPUT(16.I)
 7                GOTO 50
 8      10        CALL INPUT(18.I)
 9      50        J=0
10      100       T=I-16
11                IF(T)200.150.150
12      150       J=J+10
13                I=I-16
14                GOTO 100
15      200       XX=J+I
16                RETURN
17                END
```

```
MODULE INFORMATION:

     CODE AREA SIZE      = 007EH    126D
     VARIABLE AREA SIZE  = 000AH     10D
     MAXIMUM STACK SIZE  = 0002H      2D
     17 LINES READ

     0 PROGRAM ERROR(S) IN PROGRAM UNIT AD

     0 TOTAL PROGRAM ERROR(S)
     END OF FORTRAN COMPILATION
```

FORTRAN COMPILER

```
ISIS-II FORTRAN-80 V2.1 COMPILATION OF PROGRAM UNIT YDR
OBJECT MODULE PLACED IN :F1:DOCU3.OBJ
COMPILER INVOKED BY:  FORT80 :F1:DOCU3.PAT


  1                SUBROUTINE YDR(X)
  2                INTEGER X
  3       10       X=X-1
  4                IF(X.GT.0) GOTO 10
  5                RETURN
  6                END


MODULE INFORMATION:

     CODE AREA SIZE      = 001EH      30D
     VARIABLE AREA SIZE = 0002H       2D
     MAXIMUM STACK SIZE = 0002H       2D
     6 LINES READ

     0 PROGRAM ERROR(S) IN PROGRAM UNIT YDR

     0 TOTAL PROGRAM ERROR(S)
     END OF FORTRAN COMPILATION

ISIS-II 8080/8085 MACRO ASSEMBLER. V4.0          MODULE    PAGE    1


  LOC  OBJ          LINE        SOURCE STATEMENT

                      1          PUBLIC  CIT
                      2          CSEG
  0000 21027F         3 CIT:     LXI     H.07F02H
  0003 7E             4          MOV     A.M
  0004 2101F7         5          LXI     H.0F701H
  0007 77             6          MOV     M.A
  0008 2B             7          DCX     H
  0009 3601           8          MVI     M.1
  000B 7E             9 STAT:    MOV     A.M
  000C 07            10          RLC
  000D D20B00    C   11          JNC     STAT
  0010 2104F7        12          LXI     H.0F704H
  0013 7E            13          MOV     A.M
  0014 1F            14          RAR
  0015 1F            15          RAR
  0016 1F            16          RAR
  0017 1F            17          RAR
  0018 E60F          18          ANI     0FH
  001A 47            19          MOV     B.A
  001B 2105F7        20          LXI     H.0F705H
  001E 7E            21          MOV     A.M
  001F 4F            22          MOV     C.A
  0020 17            23          RAL
  0021 17            24          RAL
  0022 17            25          RAL
  0023 17            26          RAL
  0024 E6F0          27          ANI     0F0H
  0026 B0            28          ORA     B
```

```
0027 21007F      29      LXI     H.07F00H
002A 77          30      MOV     M.A
002B 79          31      MOV     A.C
002C 1F          32      RAR
002D 1F          33      RAR
002E 1F          34      RAR
002F 1F          35      RAR
0030 E60F        36      ANI     0FH
0032 21017F      37      LXI     H.07F01H
0035 77          38      MOV     M.A
0036 C9          39      RET
                 40      END


PUBLIC SYMBOLS
CIT     C 0000

EXTERNAL SYMBOLS


USER SYMBOLS
CIT     C 0000     STAT    C 000B

ASSEMBLY COMPLETE.    NO ERRORS
```

We claim:

1. A method for imparting a prevailing torque to a nut comprising the steps of:
   (a) placing said nut between two relatively movable jaws,
   (b) decreasing the gap between said jaws at substantially constant velocity until said jaws contact said nut,
   (c) measuring the relative deceleration of said jaws to determine the point in time at which said jaws contact said nut at the onset of deceleration,
   (d) determining the relative displacement of said jaws at substantially said point in time,
   (e) determining a target displacement by deducting from the displacement value determined in step (d) a predetermined displacement,
   (f) continuing to decrease the gap between said jaws while monitoring the spacing between said jaws,
   (g) determining when said target displacement is reached, and
   (h) when said target displacement referred to in step (g) is reached, signalling said jaws to stop closing movement and subsequently to open.

2. The method according to claim 1 wherein said predetermined displacement is the desired deformation of said nut.

3. The method according to claim 1 wherein said predetermined displacement is an amount determined to provide the desired deformation of said nut after overshoot and springback.

4. A method according to claim 1 wherein the measuring and determining set forth in steps (c) to (g) are carried out by a displacement transducer connected between said jaws and producing an output signal indicative of the displacement between said jaws and the rate of change thereof and a microprocessor for processing said output signal.

5. A method according to claim 1 wherein step (d) is carried out at a point in time after contact of said jaws with said nut and during a period when elastic deformation of said nut takes place but before plastic deformation of said nut commences.

6. A method according to claim 1 wherein step (d) is carried out by averaging a number of readings indicating said relative displacement.

7. A method according to claim 1 wherein step (d) is carried out at a point in time after contact of said jaws with said nut and during a period when elastic deformation of said nut takes place but before plastic deformation of said nut commences and wherein step (d) is carried out by averaging a number of readings indicating said relative displacement.

8. Apparatus for imparting a prevailing torque to a nut comprising:
   (a) two relatively movable jaws between which said nut may be placed,
   (b) means for opening and closing said jaws,
   (c) means connected between said jaws for producing a signal that indicates the relative displacement between said jaws and the rate of change thereof, and
   (d) signal processing means for processing said signal, said signal processing means determining from said signal the point in time when said jaws have contacted said nut and the relative displacement of said jaws at substantially said point in time, determining a target displacement by deducting from the relative displacement of said jaws a predetermined displacement, monitoring said signal until said target displacement is reached and then producing an output signal for said means for opening and closing said jaws to signal said jaws to stop closing movement and then to open.

9. Apparatus according to claim 8 wherein said means connected between said jaws for producing said signal is a displacement transducer.

10. Apparatus according to claim 8 wherein said signal processing means is a microcomputer.

* * * * *